United States Patent [19]

Ballin

[11] 3,955,245

[45] May 11, 1976

[54] SEPARABLE INTERLOCKING FASTENERS

[76] Inventor: Gene Ballin, 159 Main St., Hempstead, N.Y. 11550

[22] Filed: Aug. 14, 1974

[21] Appl. No.: 497,464

Related U.S. Application Data

[63] Continuation of Ser. No. 237,634, March 24, 1972, Pat. No. 3,829,938.

[52] U.S. Cl. ..... 24/201 C; 24/205.13 D

[51] Int. Cl. ..... A44b 17/00

[58] Field of Search ..... 24/201–207

[56] References Cited

UNITED STATES PATENTS

| | | | |
|---|---|---|---|
| 2,046,796 | 7/1936 | Sundback | 24/205.13 R |
| 2,353,858 | 7/1944 | Tedesco | 24/201 C |
| 2,558,367 | 6/1951 | Madsen | 24/201 C |
| 2,652,611 | 9/1953 | Jaster | 24/201 C |
| 2,715,254 | 8/1955 | Tschappu | 24/204 |
| 2,909,822 | 10/1959 | Botti et al. | 24/201 C |
| 3,176,364 | 4/1965 | Dritz | 24/201 C |
| 3,518,727 | 7/1970 | Eberle | 24/16 PB |
| 3,557,413 | 1/1971 | Engle | 24/204 |
| 3,561,073 | 2/1971 | Rosser | 24/205.1 |
| 3,679,531 | 7/1972 | Wienand et al. | 24/201 C |

FOREIGN PATENTS OR APPLICATIONS

| | | | |
|---|---|---|---|
| 901,041 | 1/1954 | Germany | 24/205.13 D |
| 158,946 | 9/1954 | Australia | 24/201 C |
| 1,053,953 | 1/1954 | France | 24/205.13 D |

*Primary Examiner*—Bernard A. Gelak

[57] ABSTRACT

An elongated separable fastener includes two similar sections formed of a resilient resin, each section including a longitudinally extending socket with a restricted throat and an elongated plug with an enlarged head which releasably engages the socket of the other section. Mating transverse recesses and projections are provided in the fastener sections to restrict their relative longitudinal displacement. In one form, each section includes a base web and a pair of transversely spaced longitudinal vertical plugs and longitudinally spaced projections projecting medially from the web, the space between one of the plugs and the projections defining a socket, and in another form, each section is U-shaped with enlarged heads on the side legs, longitudinally spaced transverse ribs being positioned at the base of the socket between the legs and the legs having longitudinally spaced transverse grooves. A plurality of side-by-side sections may be integrally formed as well as back-to-back sections and they may be longitudinally reinforced.

9 Claims, 16 Drawing Figures

SEPARABLE INTERLOCKING FASTENERS

This is a continuation, of application Ser. No. 237,634, filed Mar. 24, 1972, now U.S. Pat. No. 3,829,938.

BACKGROUND OF THE INVENTION

The present invention relates generally to improvements in fasteners and it relates particularly to an improved elongated separable fastener device in which the fastener sections are coupled by pressing them together and are separated by peeling one from the other.

Elongated separable fastening devices heretofore employed and proposed are of various shapes and structures and possess numerous drawbacks and disadvantages and generally represent a compromise in their operation and effectiveness. Thus the conventional elongated channel socket and plug devices are usually unreliable and offer little resistance to their relative longitudinal displacement and are accordingly of only limited application. The slide type separable fastener is an awkward and relatively expensive device of little versatility and reliability. A separable fastener which withstands a limited longitudinal pull is the type which includes two woven releasably intercoupled multiple hook and eye fabrics, marketed under the trademark "VELCRO." However this type of fastener leaves much to be desired. It requires two differently constructed sections, it is of very limited width and thickness, it is a dirty material in that it is highly retentive of foreign matter, dust and particles and tends to shed and wear out, the sections mate in a random manner, and the device absorbs moisture and is expensive and hence its use in many applications is economically unwarranted.

SUMMARY OF THE INVENTION

It is a principal object of the present invention to provide an improved separable fastener.

Another object of the present invention is to provide an improved elongated separable fastener, which is easily assembled, but resists longitudinal separation.

Still another object of the present invention is to provide an improved elongated separable fastener which is flexible and restricted against relative transverse and longitudinal displacement.

A further object of the present invention is to provide a separable fastener which prevents movement in any direction within the plane of the joining of the sections while permitting easy opening and closing in a direction transverse to the plane of joining.

A still further object of the present invention is to provide a separable fastener of the above nature characterized by its reliability, ease and convenience in use, low cost, ruggedness and long wearing properties, attractive appearance, and great versatility and adaptability.

The above and other objects of the present invention will become apparent from a reading of the following description taken in conjunction with the accompanying drawings which illustrate preferred embodiments thereof.

In a sence the present invention contemplates the provision of a separable fastener device formed of a resiliently deformable material and comprising a pair of separably interlocked first and second fastener sections, the first section having a longitudinally extending socket with a restricted entrance throat and an enlarged base, the second section having a longitudinally extending plug including a shank registering with the throat and an enlarged head registering with the socket base, and the fastener sections having longitudinally spaced separably registering means for restricting the relative longitudinal movement of the fastener sections.

In one form of the improved fastener the two fastener sections are similarly shaped and may be separate elements or integrally joined and each section includes a base web, a pair of transversely spaced side legs with enlarged heads, and longitudinally spaced projections medially located between the side legs and having concavities in their lower side faces. In the coupled condition of the fastener sections, a side leg of each section registers with the socket defining space between a side leg and the projections of an opposite section. A pair of side legs may be formed on one or both faces of the web and a plurality of side-by-side sections may be integrally formed and the fastener sections may be integrally formed along the border of a panel or web. According to another form of the separable fastener, each section is U-shaped with the side legs having enlarged heads provided with longitudinally spaced transverse grooves in the tops thereof and longitudinally spaced transverse ribs are formed on the section base. In the coupled condition, a leg of each section interdigitates the legs of the other section and the ribs are engaged resiliently by the grooves in the side legs heads.

The fastener device is advantageously formed of a resiliently deformable or flexible synthetic organic polymeric resin, for example a polyolefin such as polyethylene or polypropylene, polyvinylchloride, or the like, and it may be produced by extrusion and shaping while still in a moldable state, injection molding, or by other suitable process. The fastener sections may be at the opposite ends of a commonly formed similarly shaped band and as such may be used as a strap or belt of adjustable length or they may be secured to or formed part of other substrates which may be used in envelopes, garments, wrappings, covers, drapery, carpets and the like. The fastener sections may be secured to the substrate by sewing, adhesive, heat sealing or any other suitable manner.

The improved fastener device is rugged, reliable, of low cost, and highly versatile and adaptable and overcomes the numerous drawbacks of the earlier devices.

DESCRIPTION OF THE PREFERRED EMBODIMENTS

Figure 1:
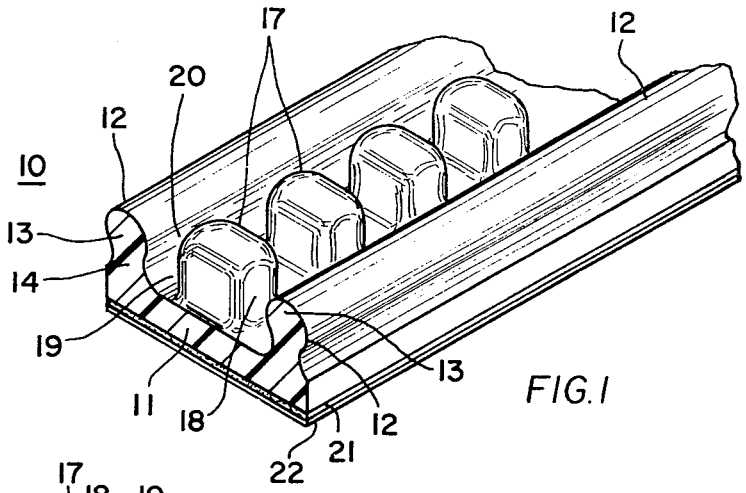
FIG. 1 is a fragmentary, enlarged, perspective view of a fastener member embodying the present invention.
Figure 2:
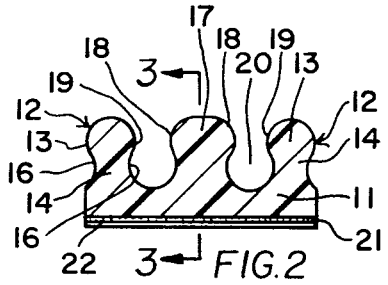
FIG. 2 is a transverse cross sectional view thereof.
Figure 3:
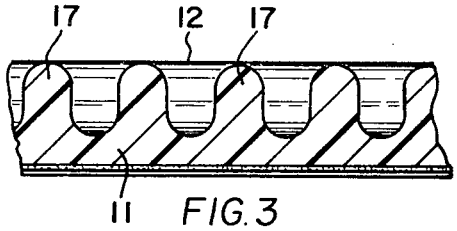
FIG. 3 is a sectional view taken along line 3 — 3 in FIG. 2.

Referring now to the drawings, particularly FIGS. 1 to 6 thereof, which illustrate a preferred embodiment of the present invention, the reference numeral 10 generally designates one of a pair of similarly shaped fastener members or sections which may be separate or may be longitudinally spaced portions of a correspondingly shaped elongated member. The section 10 is of channel shaped configuration and includes a longitudinally extending cross web 11 and a pair of integrally formed transversely spaced vertical legs 12. Each of the vertical legs 12 terminates at its top in an enlarged transversely curved longitudinally linear head 13 which extends along the length of each leg 12, the lower or shank portion 14 of the leg 12 having opposite curved side faces 16 complementing the side faces of the heads 13.

Directed upwardly from an integrally formed with the cross web 11 are regularly longitudinally spaced similary shaped upright projections 17 which are medially spaced between legs 12 and which have longitudinal dimensions or thicknesses about equal to the space between successive projections 17. Each projection 17 is rounded at its corners and edges and has curved side faces 18 spaced from and symmetric to the confronting faces 19 of legs 12. The confronting faces 18 and 19 define a pair of longitudinally extending sockets 20 of substantially the shape of plug defining legs 12 interrupted by the spaces between projections 17 and include restricted upper throat portions and enlarged base portions. As seen best in FIG. 2, projections 17 have a width greater than the distance between the confronting faces 18 and 19. Advantageously, the underface of the web 11 is coated with a pressure sensitive adhesive layer 21 which is covered by a peelable tape 22 to facilitate the securement of the fastener sections 10 to respective substrates, it being noted that different means of securement may be employed.

Figure 4:
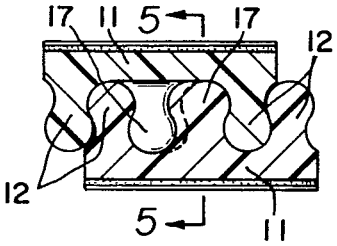
FIG. 4 is a transverse sectional view of a pair of fastener members in a coupled condition.
Figure 5:
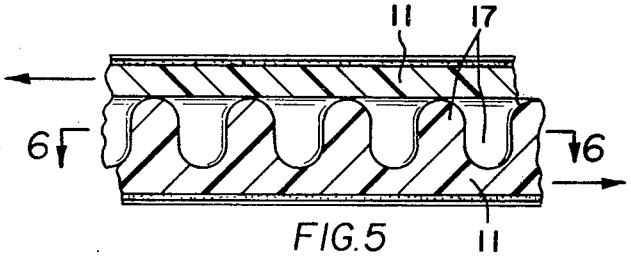
FIG. 5 is a sectional view taken along line 5 — 5 in FIG. 4.
Figure 6:
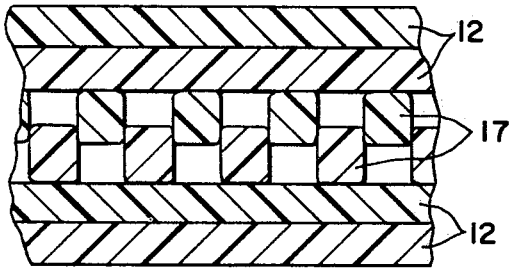
FIG. 6 is a sectional view taken along line 6 — 6 in FIG. 5.

A pair of fastener sections 10 may be separably coupled in a manner illustrated in FIGS. 4 to 6 by bringing the sections 10 with their open faces confronting each other and transversely offset so that the leg or plug 12 of one section registers with the socket 20 of the other section and with the projections 17 of one section registering with the spaces between successive projections 17 of the other section. The two sections are then progressively squeezed together along their lengths to resiliently snap the head 13 of each opposing section into engagement with a correspondingly registering socket 20 in the other section and to position the projections 17 into partially overlapping end to end interdigitating relationship. By reason of the interdigitating projections 17 relative longitudinal movement between the coupled fastener sections 10 is prevented as is any transverse movement. Separation of the fastener section 10 may be effected by peeling one from the other.

Figure 2A:
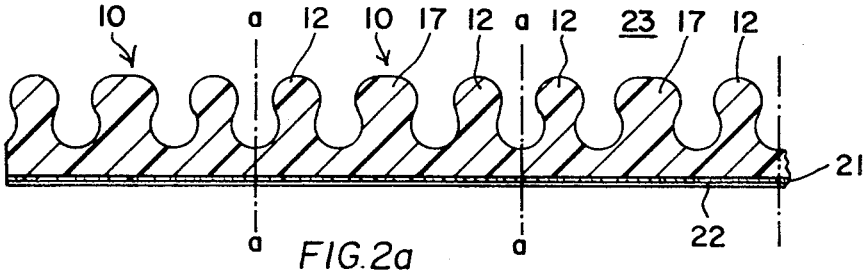
FIG. 2A is a view similar to FIG. 2 showing the fastener member in a prefinished state.

In fabricating the individual fastening sections 10 or a section including an adjoining strip, a plurality of side-by-side sections may be formed as composite body 23, as shown in FIG. 2A, and the body 23 may then be longitudinally slit along lines *a* — *a* to form the separate fastener members 10. The composite body 23 may have its underface coated with a pressure adhesive 21 and covered by a peelable film 22 which is slit with the slitting of the composite body 10 and essentially forms the unit shown in FIGS. 1–2.

Figure 7:
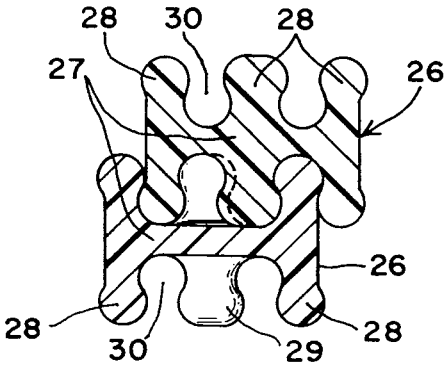
FIG. 7 is a transverse sectional view of another embodiment of the present invention showing these fastener members in a coupled condition.

In FIG. 7 of the drawing there is illustrated another embodiment of the present invention differing from that first described primarily in that plugs, sockets and projections are formed on the opposite faces of the cross web. Specifically, the separable fastener comprises a pair of similarly shaped fastener sections 26, each including a cross web 27, longitudinally extending plug defining side legs 28 directed upwardly and depending from the side borders of each cross web 27 and longitudinally spaced projections 29 medially located between each pair of side legs 28 and extending from cross web 27. The side legs define with the projections 29 upper and lower pairs of transversely spaced sockets 30. The shapes and relationships of plugs 28, projections 29 and sockets 30 correspond to those of plugs 12, projections 17 and sockets 20 of the fastener section 10 first described.

Figure 12:
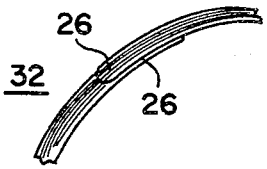
FIG. 12 is a fragmentary perspective view of a closed belt employing the improved fastener construction.

The fastener sections 26 are coupled and uncoupled in the manner first described except that either of the faces of each section 26 may be coupled with either of the faces of the other fastener section 26. Thus, as shown in FIG. 12 of the drawing, the fastener sections 26 may be defined by the opposite ends of a continuous elongated band 32 integral with and of the same transverse cross section and configuration as fastener sections 26. The band 32 may be adjusted and closed to any desired circumference without any twist by coupling the upper and lower faces of the fastener sections at preselected lengths or portions. On the other hand, when the band 32 is of a transverse cross-section not symmetric to the cross web, as the fastener sections 10, in order to couple the ends of the band 32 it must be twisted 180° about its length. Of course, pieces of sections 10 can be attached to the continuous strip and the strip fastened in the same manner.

Figure 8:
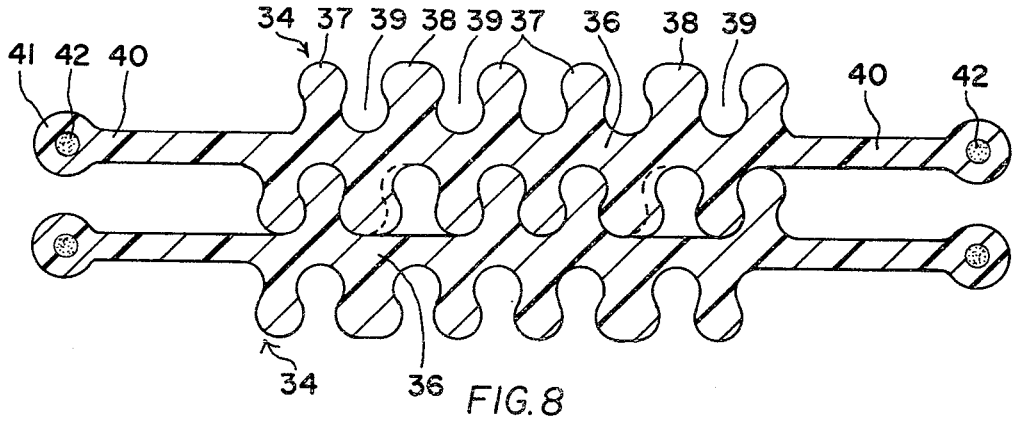
FIG. 8 is a transverse sectional view of a further embodiment of the present invention.

The embodiment of the present invention illustrated in FIG. 8 includes a pair of fastening or coupling members 34 which may be part of a common length thereof or may be separate and each coupling member 34 comprises a pair of integrally formed side by side coupling sections of the same configuration as the fastener section 26 previously described and includes a cross web 36, side legs 37, medial projections 38 and sockets 39 corresponding in shape and relationship to the corresponding elements of fastener section 26. Integrally formed with and projecting laterally from the sides of cross web 36 and of about the same thickness thereof are coplanar side webs 40. The outer borders of the side webs 40 are enlarged, as at 41, and have embedded and firmly anchored therein longitudinally extending flexible reinforcing lines 42 which may be of wire or any suitable high tensile strength line such as tenacity nylon or the like. The fastener members 34 are coupled and uncoupled in the manner earlier described and by reason of the reinforcing members 42 are of considerably greater tensile strength thereby greatly expanding its fields of application. Also, the members 34 may be fastened to a surface through side webs 40 in any convenient manner.

A further form of separable fastener embodying the present invention is shown in FIGS. 9 to 11 and 13 and includes an elongated member which, except as set forth, may be of uniform transverse cross section and terminates at opposite ends in similarly shaped separable fastener sections 43 each of which may constitute up to substantially half of the full length of the elongated member. Each of the sections 43 is of channel or U-shaped transverse cross-section, including a curved bottom cross arm 44 and similarly shaped plug defining side legs 46. The cross arm 44 and the bottom parts portions 47 of side legs 46 are of uniform thickness and the upper parts of the side legs 46 are in the form of enlarged cylindrical heads 48. An elongated socket 49 is defined by the confronting faces of side legs 46 and is of substantially the same shape as each of the side legs 46.

Formed in the base of the socket 49 and integral therewith are regularly longitudinally spaced round topped cross ribs or panels 40 which extend from the bottom of socket 49 to a point below the heads 48. Longitudinally spaced vertical transverse grooves 51 of the shape of the ribs 50 are formed in the plug heads 48 and are in vertical medial axial alignment with respective panels 50.

Figure 11:
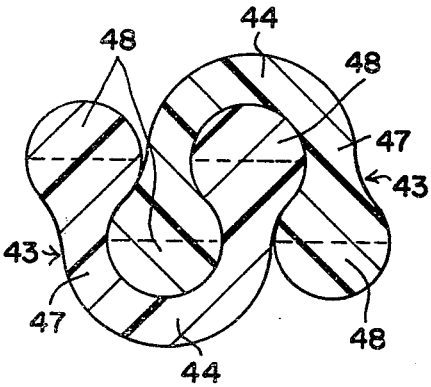
FIG. 11 is a transverse sectional view showing a pair of fasteners of FIGS. 9 and 10 in coupled condition.
Figure 13:
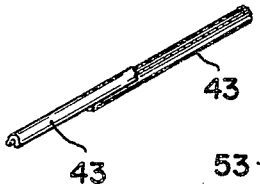
FIG. 13 is a perspective view of a pair of fastener members of FIGS. 9 to 11 in an adjusted coupled condition.

In the coupled condition of a pair of fastener sections 43, as illustrated in FIGS. 11 and 13, a plug 46 of each fastener section 43, is in engagement with a socket 49 of the other fastener section 43, the cross ribs 50 matingly engaging the grooves 51 in the socket coupled plug heads 48. The use, coupling and uncoupling of the pair of fastener sections 43, is an earlier described, relative transverse and longitudinal movement between the coupled fastener sections 43 being prevented.

Figure 14:
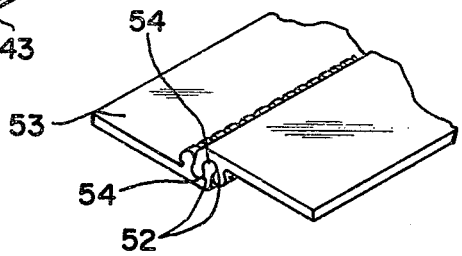
FIG. 14 is a fragmentary perspective view showing a pair of coupled fastener members associated with integrally formed webs.

As shown in FIG. 14, fastener sections 52 similar to fastener sections 43, may be provided with panels or webs 53 along the lengths of the fastener sections 52, the panels 53 projecting laterally from and integrally formed with the fastener section bottom cross arm 54. The panels 53 may be employed in any desired application such as by securing them in any suitable manner, to associated components which are to be separably joined or the panels 53, per se, may define such components and may be of any desired width and thickness.

Figure 9:
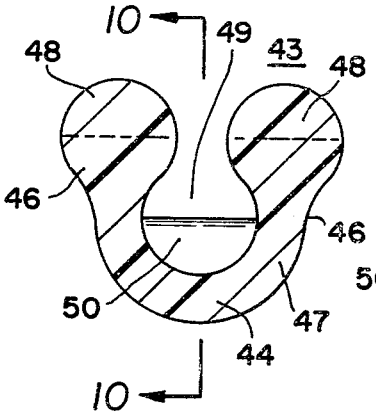
FIG. 9 is a transverse sectional view of a fastener member in accordance with a further embodiment of the present invention.
Figure 10:
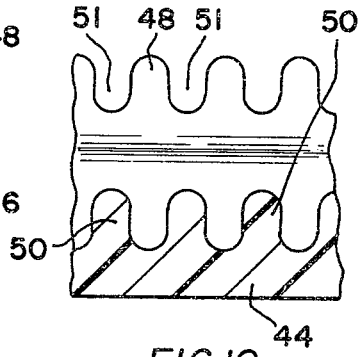
FIG. 10 is a sectional view taken along line 10 — 10 in FIG. 9.
Figure 15:
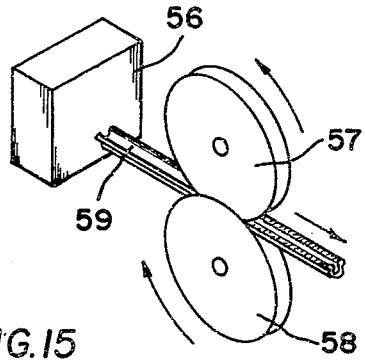
FIG. 15 is a perspective view of an apparatus which may be employed in producing the improved fasteners.

An apparatus which may be employed for producing the subject fastener devices, for example, that shown in FIGS. 9 and 10, is diagramatically illustrated in FIG. 15. The apparatus includes a conventional plastic screw extruder 56 having an extrusion die with an opening approximately of the shape shown in section in FIG. 9. Immediately following the extrusion die are a pair of cooperating upper and lower shaping wheels 57 and 58 which are driven in unison in any suitable manner. The peripheral face of the lower wheel 58 corresponds to the outer face of fastener section 43 up to about the midpoint of heads 48 and the peripheral face of the upper wheel 57 is provided with circumferentially spaced transverse ribs which correspond in shape to grooves 51 and with transverse recesses which correspond to ribs 50. Thus, a strip 59 of the desired plastic is extruded, which has a uniform cross sectional shape approximating that shown in FIG. 9, and while still in a pressure moldable state has the grooves 51 and ribs 50 formed therein. Other procedures may of course be employed to produce the improved fastener devices.

From the above description, by reason of the nature of the construction of the elements of the fastening device, the legs, heads and projections are resiliently forced into interengaging positions by flexing the resilient opposed elements during assembling, which seek to return to their unstressed position and hence, firmly hold the strips in closed interlocked position.

It is seen that the various interengaging elements of the fastening devices of the present invention extend generally normal or perpendicular from the plane of a flexible longitudinal base or support strip. The separating force lies in a plane normal to the axis of the interlocking elements and hence the possibility of separation in the direction of such pull is practically nil. Further, the strips can be made in any desired width, thickness or density.

While there have been described and illustrated preferred embodiments of the present invention it is apparent that numerous alteration, omissions and additions may be made without departing from the spirit thereof.

What I claim is:

1. A flexible fastener section for detachably fastening with a second similar section when the sections are pressed together, comprising a base web having an upper and lower surface, a pair of projecting similar side legs longitudinally extending from and transversely spaced on the upper surface of the web, each of said legs having enlarged heads with upwardly converging top side faces and downwardly converging bottom side faces and longitudinal grooves in opposite faces substantially complementing the corresponding side faces of said enlarged heads, and a series of longitudinally spaced projections extending from said upper surface of said web medially between said side legs, confronting side faces of the projections and each side leg defining a socket for receiving a side leg of the second section, when the sections are pressed together, said projections having a width, a portion of which, is greater than the width of said sockets so that when said fastener sections are pressed together the projections interdigitate and contiguous projections are transversely offset.

2. A fastener section of claim 1 further including a second fastener section extending outwardly from the lower surface of said web, said second fastener section includes a pair of transversely spaced longitudinally extending side legs similar to and extending in an opposite direction from said base web relative to said side legs of the first mentioned fastener section, and longitudinally spaced projections medially positioned on the lower surface of the web between the pair of side legs projecting therefrom, and similar to said projections on the upper surface of said web, said first and second sections being integrally formed back to back so that each has a common base with the side legs and projections of each being about 180° offset from each other.

3. The fastener section of claim 1 including a plurality of similar fastener sections which are integrally formed in side by side relationship.

4. The fastener section of claim 1 wherein said projections have side faces with concavities formed therein below the tops thereof.

5. The fastener section of claim 1 further including a layer of an adhesive material coating said lower surface.

6. The fastener device of claim 1 further including a second similar fastener section cooperating with said first section, said sections being integrally formed and longitudinally axially spaced.

7. The fastener device of claim 1 further including a longitudinally extending flexible reinforcing member embedded in said fastener section.

8. The fastener section of claim 1 including an integrally formed web extending along and projecting transversely from said fastener section.

9. A fastener section of claim 1 wherein the side faces of the legs are generally sinuous in shape.

* * * * *